US007698797B2

(12) United States Patent
Hetrick et al.

(10) Patent No.: US 7,698,797 B2
(45) Date of Patent: Apr. 20, 2010

(54) APPARATUS AND METHOD FOR FORMING A JOINT BETWEEN ADJACENT MEMBERS

(75) Inventors: Elizabeth Hetrick, Ann Arbor, MI (US); Larry Reatherford, Clarkston, MI (US); Jan Skogsmo, Molndal (SE)

(73) Assignees: Ford Global Technologies, Dearborn, MI (US); Jaguar Cars Limited, Whitley, Coventry (GB)

( * ) Notice: Subject to any disclaimer, the term of this patent is extended or adjusted under 35 U.S.C. 154(b) by 1361 days.

(21) Appl. No.: 11/049,415

(22) Filed: Feb. 2, 2005

(65) Prior Publication Data

US 2006/0168792 A1 Aug. 3, 2006

(51) Int. Cl.
*B23P 11/00* (2006.01)
*B23P 19/00* (2006.01)

(52) U.S. Cl. ..... 29/505; 29/521; 29/821; 29/283.5; 403/282; 228/110.1; 228/136

(58) Field of Classification Search ..... 29/407.05, 29/432, 432.1, 521, 524.1, 525.06, 821, 243.53, 29/283.5; 403/282, 283; 227/27, 66; 228/110.1, 228/136, 173.1, 173.2, 1.1
See application file for complete search history.

(56) References Cited

U.S. PATENT DOCUMENTS 3,056,192 A * 10/1962 Jones ..... 228/104
3,201,967 A 8/1965 Balamuth et al.
3,292,413 A * 12/1966 Falcioni ..... 72/377
3,431,593 A * 3/1969 Miller ..... 425/110
3,471,724 A 10/1969 Balamuth
3,506,062 A 4/1970 Hoffman
3,615,274 A * 10/1971 Belada ..... 428/594
3,643,483 A * 2/1972 Minchenko et al. ..... 72/56
3,754,310 A * 8/1973 Shea ..... 29/25.42
3,775,833 A 12/1973 Grube
3,897,593 A * 7/1975 Becker ..... 219/92
4,119,827 A 10/1978 Lenox
4,836,858 A 6/1989 Reinhart
4,897,912 A * 2/1990 Slasinski ..... 29/432.2
5,355,935 A 10/1994 Nogues
5,361,483 A * 11/1994 Rainville et al. ..... 29/524.1
5,376,402 A 12/1994 Louks et al.
5,842,102 A 11/1998 Montfort et al.
6,199,271 B1 * 3/2001 Hahn et al. ..... 29/715
6,523,732 B1 * 2/2003 Popoola et al. ..... 228/1.1
6,684,479 B2 * 2/2004 Wang et al. ..... 29/521
6,862,913 B2 * 3/2005 Lempenauer et al. ..... 72/430
2002/0038504 A1 * 4/2002 Engler et al. ..... 29/521
2003/0066862 A1 * 4/2003 Popoola et al. ..... 228/110.1
2003/0066863 A1 * 4/2003 Skogsmo et al. ..... 228/111.5
2003/0066869 A1 * 4/2003 Johnson et al. ..... 228/264
2003/0115927 A1 * 6/2003 Lempenauer et al. ..... 72/430

* cited by examiner

*Primary Examiner*—Jermie E Cozart
(74) *Attorney, Agent, or Firm*—Tung & Associates; Raymond L. Coppielle

(57) ABSTRACT

An apparatus and method for joining adjacent members, wherein the members are placed in an overlapping layered relationship. The members are clamped between a die and a blank holder. Once clamped, a clinching operation is performed on the members to create at least a partial bond between them. In addition to the clinching operation, a level of vibrational energy is imparted to at least one of the members to reduce clamping force requirements, promote material flow and deformation and provide increased joint strength.

16 Claims, 3 Drawing Sheets

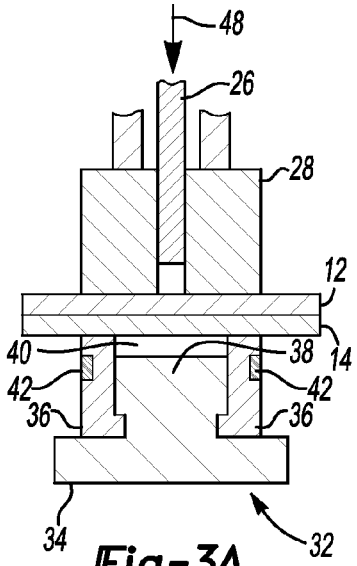
Fig-3A
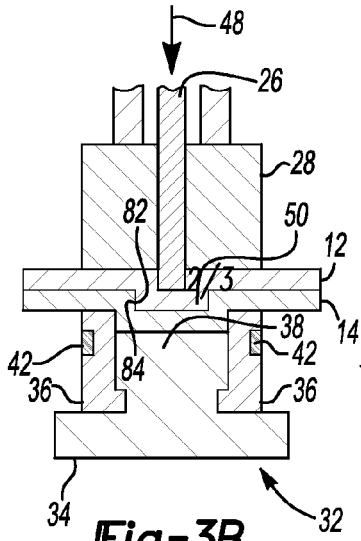
Fig-3B
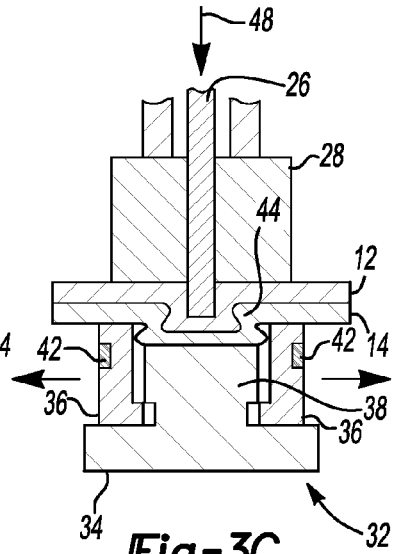
Fig-3C
Fig-4
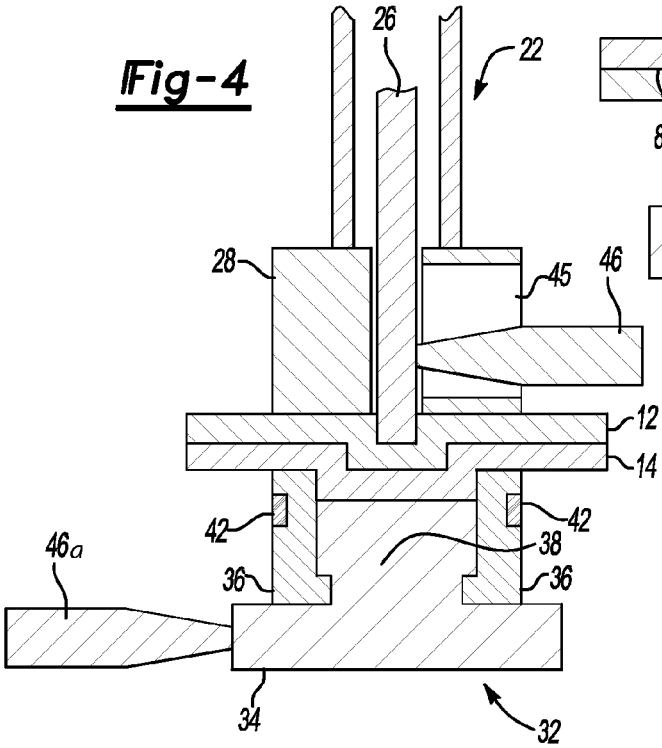
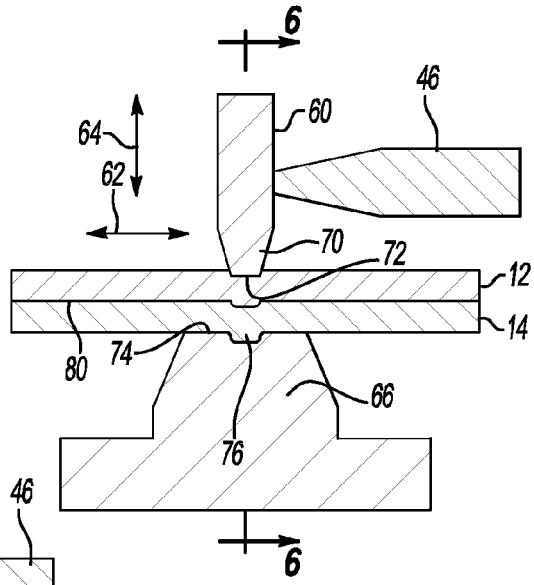
Fig-5

APPARATUS AND METHOD FOR FORMING A JOINT BETWEEN ADJACENT MEMBERS

FIELD OF THE INVENTION

The present invention relates generally to joining sheet material and more specifically, to an apparatus and method that includes using ultrasonic vibrations in combination with a clinching operation to facilitate forming a joint.

BACKGROUND OF THE INVENTION

Ultrasonic metal welding is a solid-state welding process that produces coalescence through the simultaneous application of localized high-frequency vibratory energy and moderate clamping forces. Ultrasonic welding of various materials is known and can be used to join dissimilar metals and can weld both thin sections and thin to thick sections. It can weld through most oxides and surface oils and creates negligible odor and fumes. Ultrasonic welding requires no welding consumables and is typically cost efficient. Energy consumption is low relative to resistance spot welding and variable costs are significantly lower than for self-pierce rivets.

Ultrasonic welding normally involves vibrating overlapping or adjacent workpieces clamped between a sonotrode and an anvil. Frictional forces occurring between the vibrating workpieces create a bond or weld that occurs at the interface between the workpieces, effectively joining them to one another.

Clinching is a low-cost, mechanical fastening process that can be used to join both similar and dissimilar materials of varying thickness. Clinching involves clamping the sheets in a die and using a punch to squeeze the sheets between the punch and the die causing sideways movement of the material to form an interlock or joint between the sheets. The process does not result in a heat-affected zone, requires no joining consumables, is characterized by long tool life and low maintenance requirements and does not require high current electrical systems. Clinching operations, however, employ large clamping forces, thereby requiring heavy equipment frames that can impose access limitations. In addition, clinch joints are characterized by lower peel and shear strengths than resistance spot welds and self-pierce riveted joints.

In addition, the clinching operation may require substantial deformation of the sheet material to be joined in order to form a proper bond. In some cases, the deformation can be particularly difficult, specifically when joining high-strength metal sheets, which tend to be more brittle and thus may develop cracks or stress in the joint area.

Therefore, there is a need in the art to provide an apparatus for joining two members or workpieces that utilizes or takes advantage of the benefits of both clinching and ultrasonic welding. Combining the use of ultrasonic energy with clinching overcomes limitations associated with traditional clinching operations and enhances ultrasonic metal welding capability. Accordingly, the combination of clinching and ultrasonic welding can reduce clamping force requirements, promote material flow and deformation and result in increased joint strength.

SUMMARY OF THE INVENTION

Accordingly, the present invention is a method and apparatus for joining adjacent members, including multiple layers of material, that combines a mechanical bonding process or operation with imparting vibrational energy to the members to reduce clamping force requirements, promote material flow and deformation and increase joint strength.

In one embodiment, the present invention provides a method for joining a plurality of adjacent members or multiple layers of materials including a clinching process. The method includes several steps operating alone or in combination, including the step of placing the members in an overlapping relationship and clamping the members between a die and a blank holder; performing a clinching operation wherein the clinching operation uses a punch to deform the members and create at least a partial bond between the members; and imparting a level of vibrational energy to at least one of the plurality of members before, during or after the clinching operation is performed to assist in the clinching process and in some cases, create an ultrasonic weld between the members.

Further, the present invention provides an apparatus for joining a plurality of overlapping members. The apparatus includes a punch and a die wherein the members are positioned between the punch and the die. The punch cooperates with the die to deform and form an interlock between the members. A transducer connected to either the punch or the die operates to vibrate either the punch or the die, or possibly both, and impart vibrational energy to at least one of the members either before, during or after the members are deformed by the punch and die.

In a further embodiment, the apparatus includes a sonotrode and an anvil. The plurality of overlapping members or multiple layers of material is positioned between the sonotrode and the anvil. The respective sonotrode and anvil having contact surfaces configured such that the clamping pressure exerted on the members by the sonotrode and anvil coupled with vibrational energy imparted by a transducer causes deformation of the members and creates at least a partial bond between the members.

BRIEF DESCRIPTION OF THE DRAWINGS

FIGS. 3A-3C are schematic cross-sectional side views sequentially illustrating formation of a joint between the members.

FIG. 4 is a schematic cross-sectional side view of a second embodiment of an apparatus according to the present invention for joining a plurality of members or multiple layers of material, illustrated as first and second members placed in an overlapping relationship.

FIG. 5 is a schematic, cross-sectional side view of a third embodiment of an apparatus according to the present invention for joining a plurality of members or multiple layers of material, illustrated as first and second members placed in an overlapping relationship.

DETAILED DESCRIPTION OF THE INVENTION

Figure 1:
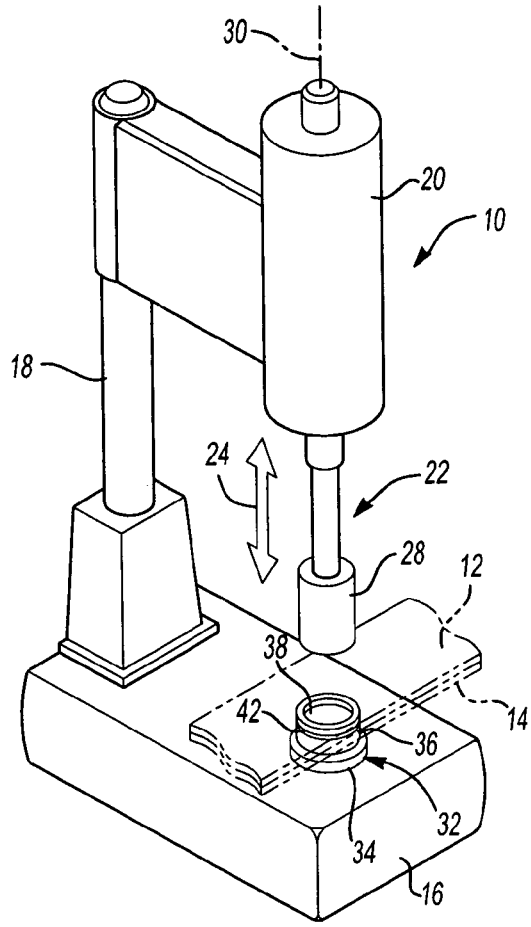
FIG. 1 is a schematic view of an apparatus according to the present invention for joining a plurality of members or multiple layers of material, illustrated as first and second members placed in an overlapping relationship.
Figure 2A:
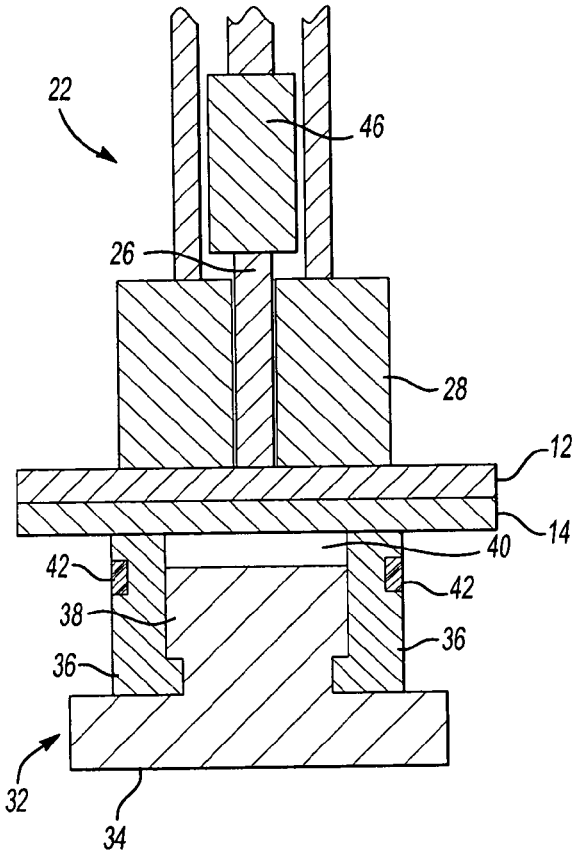
FIG. 2A is a partial cross-sectional view of the apparatus of FIG. 1 prior to joining the members.

FIGS. 1 & 2A show an apparatus for joining multiple layers of materials, seen generally at 10, according to one embodiment of the present invention. The apparatus 10 uses vibrational energy in combination with mechanical fastening to form a spot joint or bond between multiple layers of material, shown herein as first and second overlapping members or sheets of material 12, 14. While shown herein used with first and second overlapping members or sheets of material 12, 14, the present invention also contemplates the joining of more than two layers of material. Accordingly, multiple layers of materials may be joined together to form a multi-layer member.

The apparatus 10 includes a base 16, a press support and column 18 and a head 20 connected to the press support and column 18. A punch assembly 22 is mounted to the head 20 for reciprocal movement in the direction of the arrow 24. The punch assembly 22 includes a punch 26; see FIG. 2A, and a blank holder 28. An actuator (not shown) is used to drive the punch 26 in a reciprocal manner along the longitudinal axis 30 of the punch 26.

The apparatus 10 also includes a die assembly 32 secured to the base 16. The die assembly 32 includes a cylindrically shaped die 34. The cylindrically shaped die 34 includes an anvil 38. A plurality of die segments 36 surrounds the circumference of the anvil 38. The die segments 36 cooperate with the anvil 38 to form a generally annular wall defining a cavity 40. Typically, an elastic band, spring or other mechanical restraint 42 surrounds the die segments 36 to retain the die segments 36 in position about the anvil 38. While the die assembly 32 is disclosed herein as including a plurality of moveable die segments 36, this is for illustration purposes. The invention is also suitable for use with a die assembly 32 utilizing a fixed die; i.e., a die having a shaped cavity wherein the punch forces the overlapped sheets of material 12, 14 into the shaped cavity, causing the material to deform to fill the cavity.

Accordingly, the apparatus 10 is capable of performing a clinching operation to achieve at least a partial mechanical bond between the first and second sheets of material 12, 14. In accordance with a typical clinching operation, the punch 26 cooperates with the cylindrically shaped die 34 as follows: the punch 26 forces the first and second sheets of material 12, 14 down into the cavity 40. The punch 26 and anvil 38 squeeze the first and second sheets of material 12, 14 between them causing sideways movement of the material of the first and second sheets of material 12, 14 to form an interlocking button 44, see FIG. 3C.

As shown in FIG. 2A a transducer 46 is connected to the punch 26. The transducer 46 operates to impart vibrational energy through the punch 26 to at least one of the first and second sheets of material 12, 14. According to one embodiment of the invention, the vibrational energy or vibrations used are at an ultrasonic frequency. The present invention, however, does not limit the vibrational energy to an ultrasonic frequency. The invention contemplates using other frequencies. Thus, the vibrational energy can be imparted from the tool to the first or second members or sheets of material 12, 44 at selected wavelengths, frequencies and amplitudes depending upon the type of members being joined.

In the present embodiment, the transducer 46 is an ultrasonic transducer of the type utilized for ultrasonic welding. Thus, the transducer 46 operates in a known manner to impart vibrational energy along the longitudinal axis 30 or axis of punch translation. Further, in accordance with the present invention, the vibrational energy can be imparted to the first or second members or sheets of material 12, 14 at various times or stages during the bonding or fastening sequence. In addition, the vibrational energy may be imparted to the first or second members 12, 14 more than once. Specifically, the vibrational energy may be imparted at the start of the clinching operation, during the middle of the clinching operation or at the end of the clinching operation. Thus, depending upon the material being joined, the application of the vibrational energy can be varied to provide assistance with a conventional clinching operation.

For instance, upon initial contact of the punch 26 with the first member or sheet 12, ultrasonic vibrational energy may be applied or imparted to the first or second members or sheets 12, 14. The ultrasonic vibrational energy acts to reduce interfacial friction and assist in material deformation. In addition, during the clinching process ultrasonic vibrational energy may be applied or imparted to the first or second members or sheets 12, 14 since ultrasonic vibrations promote material flow and deformation and thereby reduce the risk of developing cracks in the joint area. Finally, after the clinching operation ultrasonic vibrational energy may be applied to take advantage of metal to metal solid-state joining of the first and second members or sheets 12, 14 through an ultrasonic welding process.

FIG. 2A also illustrates the blank holder 28 as separate from the punch 26. In a traditional clinching apparatus, the blank holder 28 is often attached or connected to the punch 26 with a spring type assembly. Specifically, a spring connects the punch 26 and blank holder28. Such a connection enables the blank holder 28 to move independently of the punch 26 after the blank holder 28 contacts the first sheet of material 12. As the punch 26 overcomes the spring force it slides or travels longitudinally within the blank holder 28 and continues its downward stroke to deform the first and second members or sheets of material 12, 14. The foregoing description notwithstanding, the punch 26 may be unattached and move separately from the blank holder 28.

In the current embodiment, the punch 26 is shown separate from the blank holder 28. Thus, the transducer 46 transmits the vibrational energy directly to the first and second members or sheets of material 12, 14 rather than being dampened by a spring member used to hold the blank holder 28 against the first sheet of material 12.

FIGS. 3A-3C illustrate the stages of forming a joint between first and second members 12, 14. In the disclosed embodiment the first member or sheet of material 12 and the second member or sheet of material 14 are placed in an overlapping relationship. The apparatus 10 illustrated in FIGS. 1 & 2A forms the joint. As illustrated in FIG. 3A, the blank holder 28 engages and holds the first and second members or sheets of material 12, 14 against the die segments 36. Turning to FIG. 3B, as the punch 26 moves downward, in the direction shown by the arrow 48, it contacts the first member or sheet of material 12. Upon contact the punch 26 drives the first and second members or sheets of material 12, 14 downward against the anvil 38 to deform the first and second members or sheets of material 12, 14 into a generally cylindrical, cup like shape 50.

As shown in FIG. 3C, continued downward movement of the punch 26 causes the material of the first and second members or sheets of material 12, 14 to flow laterally and create a mushroom or button shape 44 that forms a mechanical bond between the first and second members or sheets of material 12, 14. As shown, in this stage, the die segments 36 are pushed outwards, sliding on the base of the cylindrically shaped die 34 until the distance between the punch 26 and the anvil 38 reaches a preset value. As set forth above, vibrational energy, including ultrasonic energy may be applied at various stages of the clinching operation. As indicated, the punch 26 vibrating in the direction of its longitudinal axis 30 imparts or applies vibrational energy, including ultrasonic energy to the first or second members or sheets 12, 14.

Figure 2B:
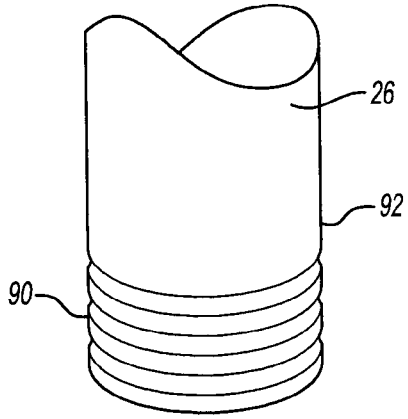
FIG. 2B is a partial perspective view of one embodiment of a punch for use with an apparatus according to the present invention.

As shown in FIG. 2B one embodiment of the present invention includes a gripping pattern, shown as a plurality of grooves 90, formed in the periphery or sidewall 92 of the punch 26. A gripping pattern similar to that formed in the periphery or sidewall 92 of the punch 26 may also be formed on the interior surface of the die segments 36 adjacent the cavity 40. In addition, the elastic band, spring or other mechanical restraint 42 may be used as a means to apply an annular clamping force to the die segments 36.

Accordingly, imparting vibrational energy along the longitudinal axis 30 of the punch 26 increases the relative motion between the sidewalls 82, 84 of the first and second members or sheets of material 12, 14 formed in the generally cylindrical cup like shape 50 shown in FIG. 3B. This in turn promotes the formation of an ultrasonic weld or bond at and between the respective sidewalls 82, 84. In addition, vibrational energy can be applied after the button 44 is formed, see FIG. 3C, to cause relative motion between the first and second members or sheets of material 12, 14 to create a weld or bond between the respective first and second members or sheets of material 12, 14.

As shown in FIG. 4, in addition to connecting the transducer 46 to the punch 26, a transducer 46*a* may be connected to the die assembly 32 and in particular the anvil 38. In this manner, the vibrational energy may be imparted to the second member or sheet 14 through contact with the die assembly 32 or through contact with the anvil 38. It should be understood that the geometry, material, temperature and surface pattern of the punch assembly 22, including the punch 26, and the die assembly 32, including the anvil 38, will impact the effectiveness of energy transmission, and in particular ultrasonic energy transmission and impartation thereof to the first or second members or sheets 12, 14 and should be optimized for minimal sticking, adhesion to the first and second members 12, 14, useful life and cost. In addition, these factors should also be considered when determining whether the vibrational energy should be imparted to the first or second members or sheets 12, 14 through either the punch assembly 22 or die assembly 32.

FIG. 4 illustrates a second embodiment of the present invention wherein the transducer 46 is secured to the punch 26 such that energy from the transducer 46 causes the punch 26 to vibrate in the lateral direction, that is, a direction transverse to the longitudinal axis 30 of the punch 26. The transducer 46 extends through an elongated longitudinal slot 45 located in the blank holder 28 and is connected to the punch 26. As set forth above, the punch 26 may impart vibrational energy at any time during the clinching operation. In addition, since the vibrational energy or ultrasonic vibrations are applied or imparted in a transverse direction, they act to impart a solid-state weld to the first and second members or sheets of material 12, 14 placed in an overlapping relationship between the punch assembly 22 and the die assembly 32 through the ultrasonic welding process as ultrasonic metal welding requires relative movement between the first and second members 12, 14.

Accordingly, the joint strength from combining the clinching and ultrasonic welding processes is considerably higher since the mechanical interlock formed by clinching is combined with the metal-to-metal solid-state joining of ultrasonic welding.

Figure 6:
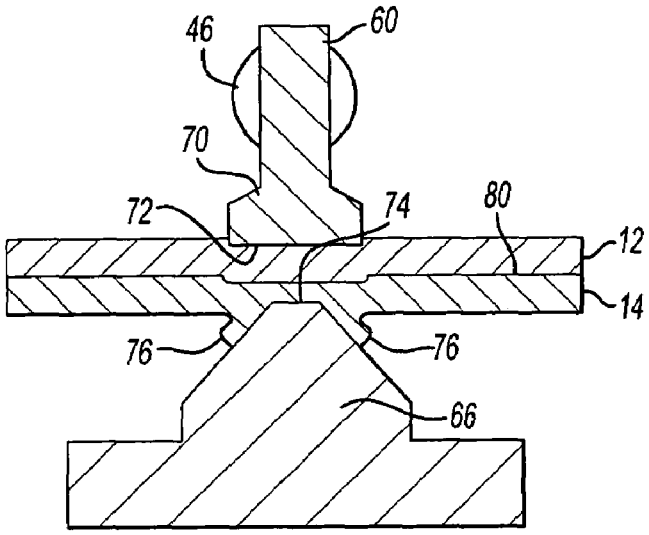
FIG. 6 is a schematic, cross-sectional front view of the third embodiment of FIG. 5.

Turning now to FIGS. 5-6, there is shown a third embodiment of the present invention for joining first and second members or multiple layers of material 12, 14 wherein the combination of the clinching and ultrasonic welding processes calls for a modification to the geometry of the sonotrode and/or the anvil 38 used in a conventional ultrasonic metal welding operation. A typical ultrasonic welding apparatus includes a sonotrode 60 mounted for movement in a side-to-side or horizontal direction of vibration, shown by the arrow 62. The sonotrode 60 also moves in a vertical manner, shown by the arrow 64, and in cooperation with an anvil 66 clamps the first and second members or sheets of material 12, 14 together in an overlapping, multi-layer relationship. As with the previous embodiments, the transducer 46 operates to transfer high frequency vibrations from the transducer 46 to the sonotrode 60 to impart vibrational energy to the first and second members or sheets of material 12, 14. The high frequency vibrations, applied at a location between the sonotrode 60 and the anvil 66, create a bond or weld at the interface or adjacent surfaces 80 of the first and second members or sheets of material 12, 14.

With a typical ultrasonic welding apparatus, both the sonotrode and the anvil have a contact surface, that is, the surface of the sonotrode or anvil that contacts either the first or second member or sheet of material 12, 14. As shown in FIG. 6, the sonotrode 60 includes a sonotrode tip 70 that is elongated along one axis such that it extends beyond the anvil 66. Thus, the sonotrode tip 70 has a contact surface 72 that is greater in one axis than a contact surface 74 of the anvil 66 in the same axis. The sonotrode tip 70 shown in FIGS. 5-6 has a contact surface 72 elongated in a direction transverse to the direction of vibration shown by the arrow 62. This is for illustration purposes only, as the contact surface 72 of the sonotrode tip 70 could also be elongated in the same axis as the direction of vibration shown by the arrow 62.

Accordingly, the clamping force applied in the direction of the arrow 64 along with the vibration of the sonotrode 60 causes deformation or material flow of the material of the first and second members or sheets of material 12, 14. In particular, as shown in FIGS. 5-6, a portion 76 of the material of the second member or sheet 14 flows over and about the edges of the anvil 66 as the sonotrode 60 deforms the first and second members or sheets 12, 14 to create at least a partial mechanical bond. While the contact surface 72 of the sonotrode tip 70 is disclosed herein as being greater than the contact surface 74 of the anvil 66, it is within the scope of the invention to change the geometry such that the contact surface 74 of the anvil 66 is greater than the contact surface 72 of the sonotrode tip 70.

Figure 7:
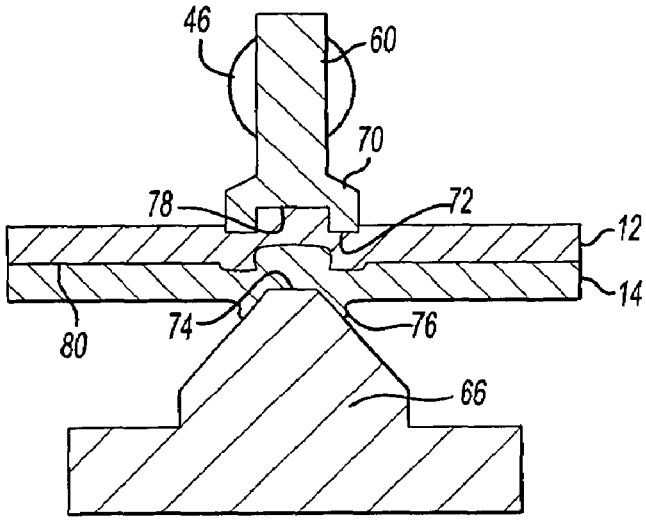
FIG. 7 is a schematic, cross-sectional front view of a fourth embodiment of an apparatus according to the present invention, similar to that shown in FIG. 5, for joining a plurality of members or multiple layers of material, illustrated as first and second members placed in an overlapping relationship.

FIG. 7 illustrates an additional embodiment of the present invention, wherein the sonotrode tip 70 of the sonotrode 60 includes an indentation or slot 78 in the contact surface 72 of the sonotrode tip 70 to facilitate deformation of the first and second members or sheets of material 12, 14. As shown in FIG. 7 the indentation or slot 78 located on the contact surface 72 of the sonotrode tip 70 cooperates with the contact surface 74 of the anvil 66 to deform the first and second members or sheets of material 12, 14 to create at least a partial mechanical bond between the first and second members 12, 14. It should be understood that other geometries and configurations of the sonotrode tip 70 and anvil 66 are also suitable to deform the first and second members or sheets of material 12, 14 to provide at least a partial mechanical bond.

The apparatus of the present invention utilizes an anvil to support the first and second members or sheets of material 12, 14 during the joining operation. In some circumstances, however, the mass and stiffness of one of the first or second members 12, 14 is adequate to allow it to act as the anvil thereby eliminating the need for a separate anvil. For instance, when joining a small or thin member to any portion of a large member or frame, the mass and stiffness of the large member or frame may be sufficient such that only the sonotrode or punch need be used. That is, no anvil is required where the mass of the larger member is sufficient to resist the clamping force of the sonotrode or punch. In addition, the clamping force of the sonotrode or punch is sufficient to locally deform both the thin member and the large member to create both an ultrasonic weld and a partial mechanical bond. Accordingly, this eliminates the need for an anvil.

In addition to applying a gripping pattern to the contact surfaces 72, 74 of the sonotrode tip 70 and anvil 66, as is typical in ultrasonic metal welding, a gripping pattern can also be applied about the periphery or perimeter of the contact surfaces 72, 74. Specifically, the surface extending along the longitudinal or clamping/punch motion axis 30 and contacting one of the first or second members or sheets of material 12, 14. This facilitates an increase in the relative motion between the first and second members or sheets of material 12, 14 to promote the formation of a stronger ultrasonic weld.

In addition, unidirectional vibrational input may result in axial variations in clinch-weld mechanical properties. Introduction of torsional ultrasonic vibrations to the punch and/or die or the use of torsional ultrasonic metal welding systems would result in more axially symmetric clinch weld properties, with the formation of a stronger ultrasonic weld not only across the bottom of the joint button but along its sidewalls. Again, the addition of a gripping pattern about the perimeter or peripheral surface of the tool extending along the longitudinal or clamping axis, promotes an increase in relative motion between the members or sheets of material to be joined and thus facilitates the formation of an ultrasonic weld. As set forth previously, the vibrational energy can be introduced or applied more than once during the clinching operation. For example, the vibrational energy can be applied initially in a direction transverse to the longitudinal axis of the punch and may then be applied in a torsional manner whereby the punch rotates about its longitudinal axis. Further, the punch may be repositioned before applying the vibrational energy a second time.

The combination of clinching and welding processes is not limited, as set forth above, to ultrasonic vibrational frequencies. Clinching and welding processes can also be combined such that they exploit lower frequency vibrations, which are characterized by higher power, energy and amplitude levels. Additionally, the vibrational energy can be applied at multiple times and in multiple directions depending upon the particular materials being joined.

It will thus be seen that the objects of the invention have been fully and effectively accomplished. It will be realized, however, that the foregoing specific embodiments have been shown and described for the purposes of illustrating the functional and structural principles of the invention and are subject to change without departure from such principles. Therefore, this invention includes all modifications encompassed within the scope of the following claims.

What is claimed is:

1. A method of joining adjacent members comprising:

placing the members in an overlapping relationship;

clamping the members between a die and a blank holder;

performing a clinching operation on the members wherein the clinching operation includes using a punch to compress said members against an anvil of said die causing material of said members to flow outwardly with respect to the longitudinal axis of said punch thereby deforming the members and creating a uninterrupted button shape that forms a mechanical bond between the members;

imparting a level of vibrational energy to at least one of the members including providing both of the punch and anvil with a laterally extending contact surface;

compressing the adjacent members between the punch and anvil wherein the contact surface of said punch engages one member and the contact surface of said anvil engages the opposite member; and using one of the punch and anvil to impart vibrational enemy to the adjacent members and create relative motion between the members and form a bond between the members after the members have undergone deformation.

2. A method of joining adjacent members as set forth in claim 1 wherein said step of imparting vibrational energy includes using the punch to impart vibrational energy to at least one of the members.

3. A method of joining adjacent members as set forth in claim 1 wherein said step of imparting vibrational energy includes using the die to impart vibrational energy to at least one of the members.

4. A method of joining adjacent members as set forth in claim 1 wherein said vibrational energy is imparted to at least one of the members at an ultrasonic level.

5. A method of joining adjacent members as set forth in claim 1 wherein the level of vibrational energy is imparted at an ultrasonic frequency and creates a bond between the members.

6. A method of joining adjacent members as set forth in claim 1 wherein the punch has a longitudinal axis and the vibrational energy is imparted to at least one of the members in the direction of the longitudinal axis of the punch.

7. A method of joining adjacent members as set forth in claim 1 wherein the punch has a longitudinal axis and the vibrational energy is imparted to at least one of the members in a direction transverse to the longitudinal axis of the punch.

8. A method of joining adjacent members as set forth in claim 1 wherein the step of imparting the vibrational energy includes imparting the vibrational energy at various times during the clinching operation.

9. A method as set forth in claim 1 wherein the step of imparting a level of vibrational energy includes imparting the vibrational energy at multiple and discrete times.

10. A method as set forth in claim 1 wherein the punch has a longitudinal axis and the vibrational energy is imparted to at least one of the members in at least one of several directions relative to a longitudinal axis of the punch.

11. A method as set forth in claim 1 wherein the punch has a longitudinal axis and the vibrational energy is imparted to at least one of the members in a direction about the longitudinal axis of the punch.

12. An apparatus for joining adjacent members comprising:

a sonotrode, said sonotrode having a contact surface;

an anvil, said anvil having a contact surface, said sonotrode cooperating with said anvil to clamp said members between said contact surface of said sonotrode and said contact surface of said anvil;

a transducer connected to one of said sonotrode and said anvil, said transducer operative to vibrate one of said sonotrode and said anvil and impart vibrational energy to at least one of said members;

said contact surface of said sonotrode is elongated in at least one axis such that said contact surface of said sonotrode extends laterally to a point wherein said contact surface of said sonotrode extends past an outer edge of said contact surface of said anvil; and said contact surface of said sonotrode and said contact surface of said anvil configured such that the clamping pressure exerted on said members by said sonotrode causes deformation of said members to form at least a partial mechanical bond between said members.

13. An apparatus as set forth in claim 12 wherein said contact surface of said anvil is elongated in at least one axis such that a portion of said contact surface of said anvil extends laterally to a point wherein it extends past an outer edge of said contact surface of said sonotrode.

14. An apparatus as set forth in claim 12 wherein said contact surface of said sonotrode has a greater surface area than the contact surface of said anvil.

15. An apparatus as set forth in claim 12 wherein said contact surface of said anvil has a greater surface area than the contact surface of said sonotrode.

16. An apparatus as set forth in claim 12 including an indentation located in one of said contact surface of said sonotrode and said contact surface of said anvil.

* * * * *

UNITED STATES PATENT AND TRADEMARK OFFICE

CERTIFICATE OF CORRECTION

PATENT NO. : 7,698,797 B2
APPLICATION NO. : 11/049415
DATED : April 20, 2010
INVENTOR(S) : Hetrick et al.

It is certified that error appears in the above-identified patent and that said Letters Patent is hereby corrected as shown below:

In Column 3, Line 59, kindly delete "44" and insert --14--.

Signed and Sealed this

Thirty-first Day of August, 2010

David J. Kappos

David J. Kappos
*Director of the United States Patent and Trademark Office*